United States Patent [19]

Evers

[11] Patent Number: 4,788,438

[45] Date of Patent: Nov. 29, 1988

[54] CONTAINER HAVING ENGAGING ABUTMENTS THEREON

[75] Inventor: John H. Evers, Bellingham, Mass.

[73] Assignee: E. I. Du Pont de Nemours and Company, Wilmington, Del.

[21] Appl. No.: 4,703

[22] Filed: Jan. 20, 1987

[51] Int. Cl.[4] ..... G21F 5/00

[52] U.S. Cl. ..... 250/506.1; 376/272

[58] Field of Search ..... 250/506.1, 507.1; 376/272

[56] References Cited

U.S. PATENT DOCUMENTS

| | | | |
|---|---|---|---|
| 3,531,644 | 9/1979 | Koster | 250/106 |
| 3,655,985 | 4/1972 | Brown et al. | 250/108 R |
| 3,673,411 | 6/1972 | Glasser | 250/108 R |
| 3,811,591 | 5/1974 | Novitch | 215/12 R |
| 3,882,315 | 5/1975 | Soldan | 250/506 |
| 3,912,935 | 10/1975 | Harris | 250/506.1 |
| 3,971,955 | 7/1976 | Heyer et al. | 250/507 |
| 4,020,355 | 4/1977 | Czaplinski et al. | 250/506 |
| 4,074,824 | 2/1978 | Kontes | 215/365 |
| 4,081,688 | 3/1978 | Fries | 250/506 |
| 4,084,097 | 4/1978 | Czaplinski et al. | 250/506 |
| 4,382,512 | 5/1983 | Furminger | 206/446 |
| 4,435,358 | 3/1984 | Krieger | 250/506.1 |

*Primary Examiner*—Bruce C. Anderson

[57] ABSTRACT

A receptacle for a carrying a vessel therein is provided with abutments that engage against the vessel itself or against a shield that receives the vessel to prevent relative motion of the vessel with respect to the receptacle as a torque is applied to the cap of the vessel.

8 Claims, 3 Drawing Sheets

CONTAINER HAVING ENGAGING ABUTMENTS THEREON

FIELD OF THE INVENTION

The present invention relates to a container for a vessel having a radionuclide therein, and in particular, to a container having an engaging arrangement for supporting the vessel and facilitating the opening thereof.

DESCRIPTION OF THE PRIOR ART

Radionuclides in liquid form are usually packaged in a glass or plastic vial which is itself received in a protective vessel. The vessel has a body with a central cavity therein which closely accepts the vial. The mouth of the cavity is closed by a resilient septum. A oap is threadedly attached to the body of the vessel. The vessel in its assembled state is itself received in a container formed from a receptacle and a lid. A lead shield is loosely inserted into the receptacle. The shield is provided with an opening that is shaped in conformity to the shape of the exterior of the vessel. The container is closed by a detachable lid.

In practice it is often difficult to expeditiously remove the cap from the body of the vessel. U.S. Pat. No. 4,382,512 (Furminger) discloses a packaging system for a radionuclide. The system includes a container having a lug in its base which engages a cutout provided on the lower end of the vessel. In this system a separate tray is provided which carries a clamping arrangement thereon. The clamping arrangement accepts the container and holds it in position during uncapping. The lid of the container is provided with a contoured recess which matches the contour of the exterior of the cap of the vessel. The lid of the container thus acts as a wrench to provide a mechanical advantage to rotate the cap from the vessel as the container is held by the clamping arrangement on the tray. The engagement of the lug into the cutout prevents rotation of the vessel within the container. It may be appreciated from the foregoing that the packaging system is awkward and difficult to use.

In view of the foregoing it is believed advantageous to provide a packing system for a radionuclide that is less cumbersome to utilize and that may be more readily useful in the uncapping of the vessel.

SUMMARY OF THE INVENTION

In accordance with the present invention a container is provided for carrying a vessel having a radionuclide therein. The vessel has a body portion with a cap threadedly secured thereto, the cap having an exterior surface having a predetermined contour. The container comprises a receptacle and a lid detachably secured to the receptacle along the upper edge thereof. The receptacle has a base and a sidewall cooperating to define a volume therein.

The base has an array of abutments extending from the base into the volume. In the preferred embodiment of the invention each abutment has a pair of interior planar surfaces thereon which snugly engage against the exterior side surfaces of a vessel when the vessel is received within the volume. The lid has an open and a closed end and an exterior and interior surface thereon. with the exterior surface of the lid having a recess contoured to conform to the contour of the cap so that the lid, when inverted, may act as a wrench whereby a torque may be applied to the lid. The torque is transmitted into the cap to threadedly loosen the cap from the body of the vessel. During this action the abutments engage the body of the vessel to prevent rotation of the body of the vessel within the receptacle as the torque is applied to the lid. In another arrangement the abutments have at least an upper edge thereon which engages snugly against the exterior of the body of the vessel to prevent the rotation of the vessel within the receptacle.

In an alternate embodiment of the invention a shield is provided having an exterior surface and an opening therein, the opening being shaped to conform to the exterior surface of the vessel. The shield is received snugly within the receptacle with the abutments engaging against the exterior surface of the shield. When the vessel is received in the opening in the shield and the lid is inverted to form the wrench the abutments engage the shield to prevent rotation of the body of the vessel with respect to the shield as the torque is applied to the lid of the vessel.

BRIEF DESCRIPTION OF THE DRAWINGS

The invention will be more fully understood from the following detailed description thereof, taken in connection with the accompanying drawings which form a part of this application and in which.

DETAILED DESCRIPTION OF THE INVENTION

Figure 1:
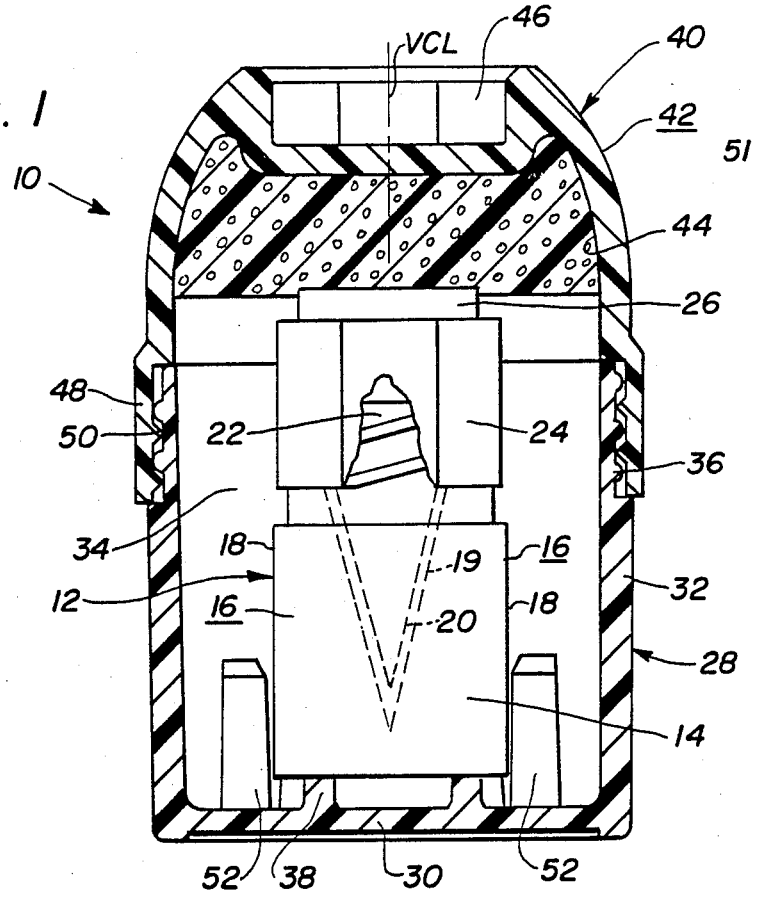
FIG. 1 is a side elevational view, entirely in section, of a container in accordance with one embodiment of the present invention having a protective vessel received therein.

Throughout the following detailed description similar reference numerals refer to similar elements in all figures of the drawings.

With reference to FIG. 1 shown is a side elevational view entirely in section of a container generally indicated by reference character 10 in accordance with the present invention. The container 10 is adapted to receive a vessel generally indicated by reference character 12. The vessel carries a radionuclide therein. The vessel 12 includes a body portion 14 having a plurality of planar walls 16 terminating in corners 18. The exterior of the body 14 of the vessel 12 defines a predetermined exterior configuration, typically square. The vessel 12 has a central cavity 19 (FIG. 1) therein. The cavity 19 receives a vial 20 in which the radionuclide is disposed. The mouth of the cavity 19 in the body 14 of the vessel 12 is closed by a resilient septum (not shown). The body 14 has a threaded neck 22 onto which a cap 24 is threadedly received. A portion of the neck 22 is visible in the cutaway portion of the cap 24 in FIG. 1. The cap 24 has a predetermined exterior configuration, typically hexagonal. The cap 24 has an access port (not shown) which is covered by a pivotable cover 26 whereby access may be afforded to the resilient septum.

The container 10 itself comprises a receptacle portion 28 formed of a base 30 with a sidewall 32 extending upwardly therefrom. In practice the base 30 is preferably circular in plan and the sidewall 32 takes the form of a right circular cylinder, although it should be understood that the configuration of this portion of the container 10 may exhibit any convenient configuration. The base 30 and the sidewall 32 cooperate to define a volume 34 on the interior of the receptacle 28 in which the vessel 12 is received. The upper edge of the sidewall 32 is provided with external threads 36. An annular footing 38 is disposed centrally on the base 30 of the receptacle 28. The footing 38 supports the undersurface of the body 14 of the vessel 12 when the same is received in the receptacle 28.

A substantially dome-sbaped lid 40 (FIG. 1) is provided with an exterior surface 42 and an interior surface 44. The lid 40 has a contoured recess 46 formed on the exterior surface 42 thereof. The contour of the recess 46 matches the contour of the exterior of the cap 24 of the vessel 12, for a purpose to be made clearer herein. A skirt 48 extends from the lower edge of the lid 40. The interior surface of the skirt 48 is provided with threads 50 whereby the lid 40 may be detachably secured to the threads 36 on the upper edge of the receptacle 28. It should be understood that any suitable means of detachable connection between the lid 40 and the receptacle 28 may be used and remain within the contemplation of the present invention. Both the receptacle 28 and the lid 40 are formed from high density polyethylene by a suitable molding process although it should be understood that any suitable alternative material and any suitable alternate manufacturing process may be used to form these members and remain within the contemplation of the present invention. A pad 51 (FIG. 1) of absorbent material, such as polyurethane foam or compressed cellulosic sponge, is disposed on the interior of the lid 40. The pad 51 abuts the upper surface of the cover 26 of the cap 24 of the vessel 12 when the same is received within the receptacle 28 and the lid 40 secured thereto.

Figure 3:
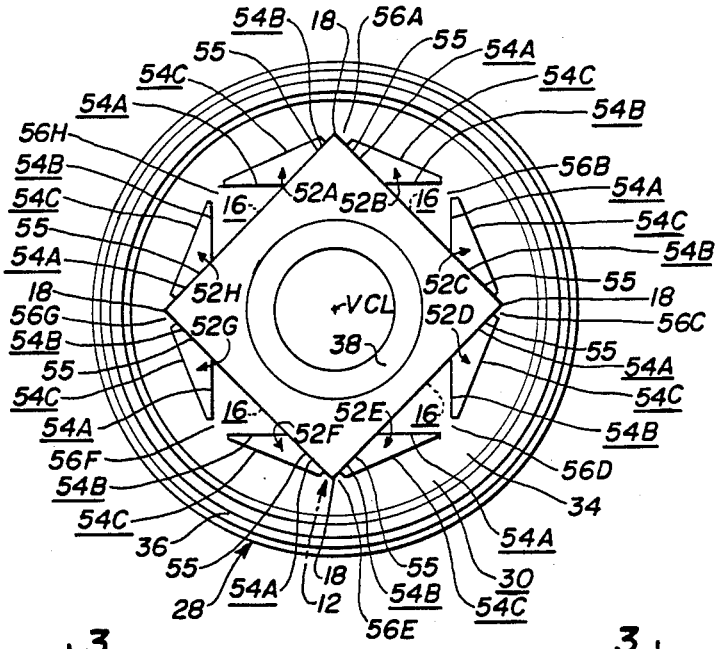
FIG. 3 is a plan view taken along view lines 3—3 in FIG. 2 of the receptacle portion of the container of the present invention.
Figure 2:
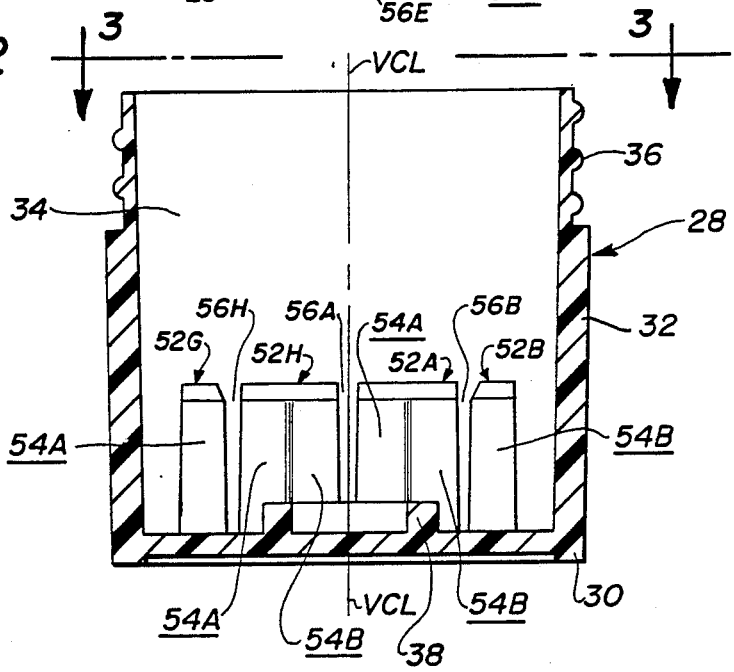
FIG. 2 is a side elevationa 1 view entirely in section of the receptacle portion of the container of FIG. 1.

In accordance with the present invention the base 30 of the receptacle 28 is provided with an array of abutments 52 which extend in a predetermined arrangement about the central axis VCL of the receptacle 28. In the preferred embodiment, as best seen in FIGS. 2 and 3, an array of abutments 52A through 52H is provided. Each of the abutments 52 is a three sided member in which the interior two of the hree sides 54A. 54B are presented to the footing 38. The remaining surface 54C of the abutments 52 is presented away from the footing 38. Gaps 56 are defined between adjacent ones of the abutments 52.

Figure 4:
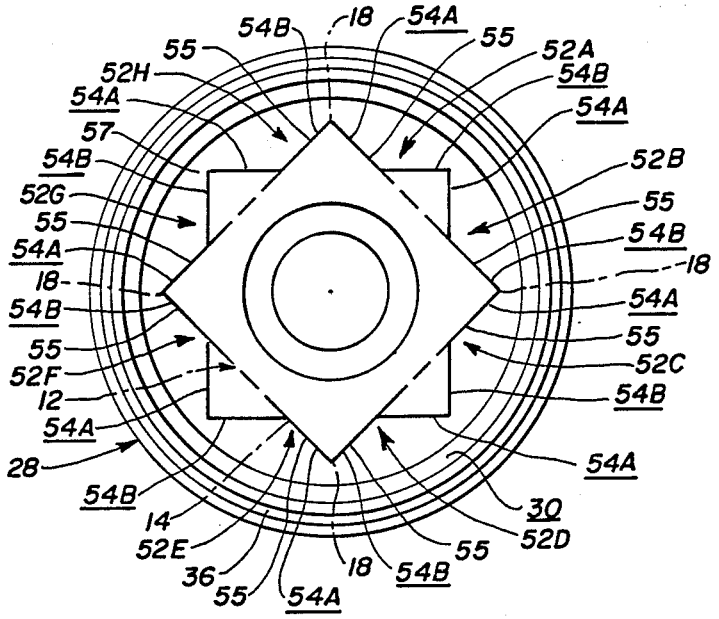
FIG. 4 is a view similar to FIG. 3 showing an alternate arrangement of the abutments on the base of the receptacle.

The abutments 52 may be alternately arranged as shown in FIG. 4. In this embodiment the surfaces 54A, 54B of adjacent abutments 52 join to define a star-shaped pattern surrounded by a substantially annular ring 57 provided on the base 30 of the receptacle. In this embodiment the gaps 56 are eliminated. The embodiment of FIGS. 2 and 3 is preferred for ease of manufacture.

In operation, in either the embodiment of FIGS. 2, 3 or the embodiment of FIG. 4, the abutments 52 are arranged within the receptacle 28 such that one of the interior surfaces 54A or 54B on each of the abutments 52 lies coplanar with the exterior surfaces of the walls 16 of the body portion 14 of the vessel 12. Thus, as seen in FIG. 3. the body 14 of the vessel 12 is received in the receptacle 28 such that the corners 18 thereof lie in one of the gaps 56 (FIG. 3) between adjacent abutments 52 and such that the interior surfaces 54A or 54B of those abutments 52 adjacent the gap 56 which receives the corner 18 engage against surfaces of the walls 16 of the body 14 of the vessel 12.

For example, as seen in FIG. 3, the body 14 of the vessel 12 may be received In the receptacle such that the corners 18 of the body 14 of the vessel 12 extend into the qaps 56A. 56C, 56E and 56G. In this case the surface 54B of the abutment 52A and the surface 54A of the abutment 52B each engage against a surface of a wall 16 of the body 14 of the vessel 12. In the instance of the gap 56C, the second surface 54B of the abutment 52C and the first surface 54A of the abutment 52D engage against a surface of a wall 16 of the body 14 of the vessel 12. The relationship of the other of the abutments 52 and the surfaces of the walls 16 of the body 14 of the vessel 12 is apparent from FIG. 3. It may also be appreciated that the body 14 of the vessel 12 may be received within the receptacle 28 such that the corners 18 thereof are received in the gaps 56B, 56D 56F and 56H. In this event the same situation is extant as that earlier is discussed, viz., one of the interior surfaces 54A or 54B of each of the abutments 52 is engaged against the exterior surfaces of the walls 16 of the body 14 of the vessel 12. In the embodiment of FIG. 4 the qaps 56 are eliminated. However the same interengagement between the surfaces 54A, 54B of the abutments 52 and the surfaces of the walls 16 of the body 14 of the vessel 12 as discussed above is defined.

In practice the surfaces 54 of the abutments 52 engage against the vessel 12 such that the vessel 12 is prevented from rotating with respect to the receptacle 28 When the recess 46 of the exterior of the lid 40 of the container 10 is fitted over the exterior of the cap 24 of the vessel 12 and the lid 40 is used as a wrench to assist in the uncapping of the cap 24 from the vessel 12. The engagement of the abutments 52 with the exterior of the body 14 of the vessel 12 thus permits a torque to be applied to the cap 24 to unthread the same from the body 14 of the vessel 12.

Figure 6:
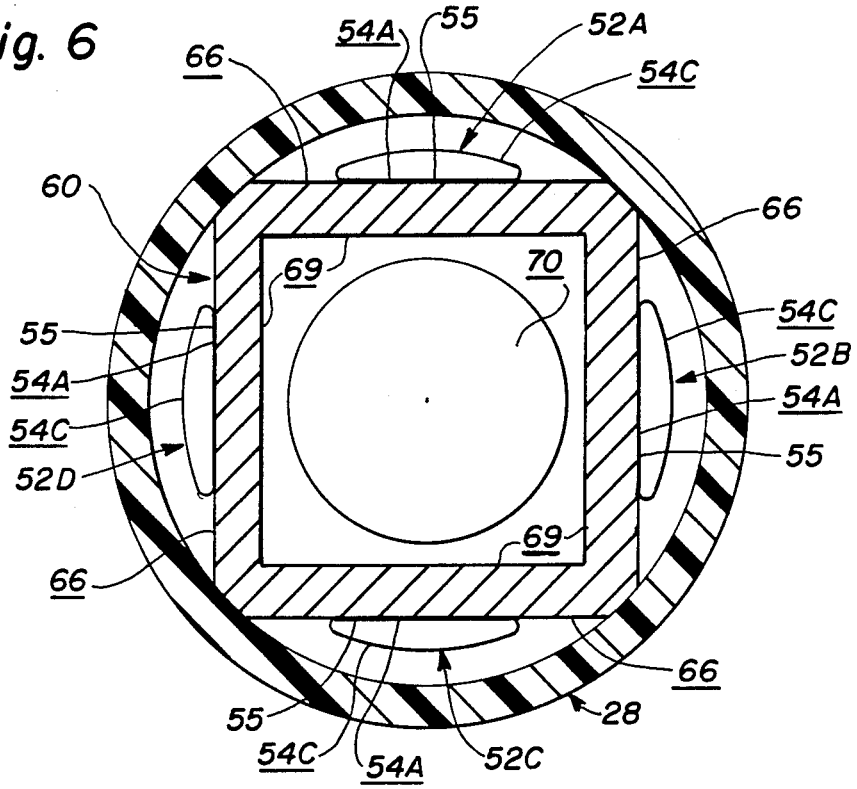
FIG. 6 is a sectiona1 view taken a1ong section lines 6—6 of FIG. 5.
Figure 5:
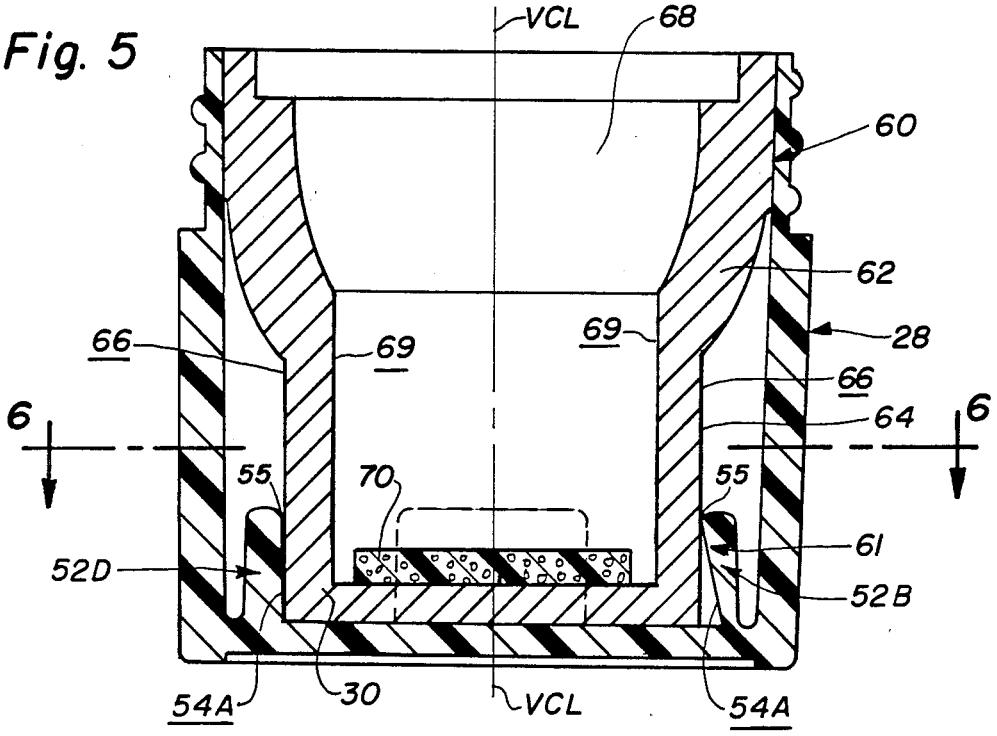
FIG. 5 is a side elevational view in section showing another embodiment of the container of the present invention in which a shield is received within the container.

In some instances it is preferable that a lead shield 60 be used to surround the vessel 12 having the nuclide therein. In this event the embodiment of the invention shown in FIGS. 5 and 6 may be used. In this embodiment of the invention the shield 60 takes the form of a lead insert having a curved upper portion 62 with a integral lower portion 64. The lower portion 64 has a plurality of walls 66 thereon. The walls 66 are shaped in any predetermined configuration, typically square. The abutments 52 in this embodiment of the invention have at least one planar interior surface 54A which, when the lower portion 64 of the shield 60 is received in the receptacle 28. engages and abuts the surfaces 66 of the lower portion 64 of the shield 60. The shield 60 has an opening 68 with interior surfaces 69 thereon which is contoured to closely match the contour of the exterior of the body portion 14 of the vessel 12. A pad 70 of absorbent material, such as used for the pad 51 (FIG. 1), is provided in the base of the shield 60. When the shield 60 is received in the receptacle 28 the interior surfaces 54A of the abutments 52 abut the exterior surfaces 66 of the lower portion 64 of the shield 60. When the vessel 12 is received in the opening 68 of the shield 60 the exterior surfaces of the walls 16 of the vessel 12 abut the interior surfaces 69 of the lower portion 64 of the lead shield 60. The interactive engagement of the surfaces 54 of the abutments 52 with the exterior of the shield 60 and the interactive engagement of the interior surfaces 69 of the shield 60 with the exterior surfaces of the walls 16 of the vessel 12 prevent relative rotation of the shield 60 and the vessel 12 with respect to the receptacle 28 when the recess 46 of the lid 40 of the container 10 is fitted over the exterior of the cap 24 of the vessel 12 and the lid 40 is used as a wrench to assist in the uncapping of the cap 24 from the vessel 12. Thus, similar to the embodiments earlier discussed, the engagement of the abutments 52 with the exterior surfaces 66 of the lead shield 60 and the engagement of the interior surfaces 69 of the shield 60 with the exterior of the body 14 of the vessel 12 permits a torque to be applied to the cap 24 to unthread the same from the body 14 of the vessel 12.

Although in the preferred instance the entire inner surface 54 of the abutment 52 should engage the exterior surface 66 of the lower portion 64 of the shield 60, it should be understood that if at least the upper edge 55 of the inner surface 54 of the abutment 52 engages against the exterior surface 66 of the lower portion 64 of the shield 60 rotation of the vessel 12 with respect to the receptacle 28 is prevented. It should also be appreciated, as seen for example at 61 in FIG. 5, that the abutments 52 may be undercut so that only a holding edge 55 is defined and remain within the contemplation of the present invention. It should also be understood that the configuration and arrangement of the abutments 52 as used in FIGS. 5 and 6 (including an abutment as modified at 61) may be applied with equal efficacy to the embodiment of FIGS. 1 through 3 and FIG. 4 wherein the abutments 52 directly engage against the exterior surfaces of the walls 16 of the body 14 of the vessel 12. Likewise it should be appreciated that the configuration of the abutments in FIGS. 1 to 3 and FIG. 4 may be used in the embodiment of FIGS. 5 and 6.

Those skilled in the art having the benefit of the teachings of the present invention may effect numerous modifications thereto. It should be appreciated that these and other modiiications are to be construed as lying within the scope of the present invention as defined in the appended claims.

What is claimed is:

1. A container for carrying a vessel having a radionuclide therein, the vessel having a body portion with a cap threadedly secured thereto, the body portion having a plurality of planar walls that terminate in a predetermined number of corners, the cap having an exterior surface having a predetermined contour, the container comprising:

a receptacle having a base and a sidewall, the sidewall having an edge thereon, the sidewall and the base cooperating to define a volume therein, the base having an array of abutments extending from the base into the volume, each abutment having a holding edge thereon engaging against the exterior of the planar walls of a vessel when the vessel is received within the volume, the holding edges of adjacent abutments engaging against each of the planar walls of the vessel in the vicinity of the corners thereof; and a lid having an open and a closed end and an exterior and interior surface thereon, the lid being detachably connectable at its open end to the edge of the sidewall, the exterior surface of the closed end of the lid having a recess contoured to conform to the contour of the cap so that the lid, when inverted, may be insertable onto the cap and the cap receivable into the recess therein such that a torque applied to the lid is transmitted into the cap to threadedly loosen the cap from the body of the vessel, the abutments engaging the exterior of the body of the vessel to prevent rotation of the body of the vessel within the receptacle as the torque is applied to the lid.

2. The container of claim 1 wherein each abutment has a planar surface thereon and wherein the planar surface of each abutment engages against the vessel.

3. A shielded container for carrying a vessel having a radionuclide therein, the vessel having a body portion with a cap threadedly secured thereto, the cap having an exterior surface having a predetermined contour, the container comprising:

a receptacle having a base and a sidewall, the sidewall having an edge thereon, the sidewall and the base cooperating to define a volume therein, the base having an array of abutments extending from the base into the volume, each abutment having a holding edge thereon, a shield having an exterior surface defined by a plurality of planar walls and having an opening therein, the opening being shaped to conform to the exterior surface of the vessel, the shield being received snugly within the receptacle with the exterior surface of each of the planar walls of the shield being engaged by one of the abutments; and a lid having an open and a closed end and an exterior and interior surface thereon, the lid being detachably connectable at its open end to the edge of the sidewall, the exterior surface of the closed end of the lid having a recess contoured to conform to the contour of the cap so that the lid, when inverted, may be insertable onto the cap and the cap receivable into the recess therein such that a torque applied to the lid is transmitted into the cap as the vessel is received in the opening in the shield to threadedly loosen the cap from the body of the vessel, the abutments engaging the shield to prevent rotation of the body of the vessel with respect to the shield and receptacle as the torque is applied to the lid.

4. The container of claim 3 wherein each abutment has a planar surface thereon and wherein the planar surface of each abutment engages against the shield.

5. The container of claim 1 wherein the abutments are spaced from each other to define predetermined gaps therebetween, the holding edges of the abutments engaging against the walls of the vessel in the vicinity of the corners thereof while the corners of the vessel project through the gaps therebetween.

6. The container of claim 2 wherein the abutments are spaced from each other to define predetermined gaps therebetween, the holding surface of the abutments engaging against the walls of the vessel in the vicinity of the corners thereof while the corners of the vessel project through the gaps therebetween.

7. The container of claim 3 wherein the planar walls of the shield define a predetermined plurality of corners and wherein the abutments are arranged with respect to each other to define predetermined spaces therebetween, the holding edges of the abutments engaging against the walls of the shield while the corners of the shield project through the spaces between the abutments.

8. The container of claim 4 wherein the planar walls of the shield define a predetermined plurality of corners and wherein the abutments are arranged with respect to each other to define predetermined spaces therebetween, the holding surfaces of the abutments engaging against the walls of the shield while the corners of the shield project through the spaces between the abutments.

* * * * *